US006910679B1

(12) United States Patent
Vogt et al.

(10) Patent No.: US 6,910,679 B1
(45) Date of Patent: Jun. 28, 2005

(54) VARIABLE CONTROLLED GUIDE DEVICE FOR WIRELINE SPOOLER

(75) Inventors: Dewayne Vogt, Tulsa, OK (US); John Brittain, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 0 days.

(21) Appl. No.: 10/452,627

(22) Filed: Jun. 2, 2003

(51) Int. Cl.[7] ..... B66F 1/00
(52) U.S. Cl. ..... 254/385; 242/157.1; 242/548
(58) Field of Search ..... 254/385, 330, 254/331; 242/548, 157 R, 157.1, 397.3, 476.9

(56) References Cited

U.S. PATENT DOCUMENTS

| | | | | |
|---|---|---|---|---|
| 190,811 | A * | 5/1877 | Bevelander | 242/397.2 |
| 1,615,161 | A | 1/1927 | Bouvier | |
| 1,649,184 | A * | 11/1927 | Posey | 242/157.1 |
| 2,660,382 | A | 11/1953 | Wilson | 242/158 |
| 2,738,938 | A * | 3/1956 | Benson et al. | 242/157.1 |
| 2,946,561 | A | 7/1960 | Thorson et al. | 254/145 |
| 2,990,136 | A | 6/1961 | Wilkinson | 242/157.1 |
| 3,614,019 | A | 10/1971 | Slator et al. | 242/157.1 |
| 4,848,697 | A | 7/1989 | Skalleberg | 242/158 |
| 4,892,262 | A * | 1/1990 | Hurst | 242/157.1 |
| 5,038,871 | A | 8/1991 | Dinsdale | 175/52 |
| 5,385,314 | A * | 1/1995 | Hughes | 242/397.3 |
| 5,388,781 | A * | 2/1995 | Sauber | 242/388.6 |
| 6,264,128 | B1 | 7/2001 | Shampine et al. | 242/397.3 |
| 6,435,447 | B1 * | 8/2002 | Coats et al. | 242/483 |

* cited by examiner

*Primary Examiner*—Emmanuel Marcelo
(74) *Attorney, Agent, or Firm*—Head, Johnson & Kachigian

(57) ABSTRACT

A guide device for a wireline spooler having an axis. A carriage is spaced from the spooler with the carriage including an upstanding fairlead to receive a wireline. A first mechanism reciprocates the carriage laterally parallel to the spooler axis. A second mechanism raises and lowers the carriage in a direction vertical to the first mechanism. The first and second mechanisms operate independently of each other and operate independently of a drive mechanism for winding the wireline.

7 Claims, 2 Drawing Sheets

VARIABLE CONTROLLED GUIDE DEVICE FOR WIRELINE SPOOLER

BACKGROUND OF THE INVENTION

1. Field of the Invention

The present invention is directed to a variable controlled guide for a wireline spooler having independent variable controls to reciprocate a spooler guide horizontally and to raise and lower the spooler guide vertically.

2. Prior Art

On drilling and other rigs, masts are provided with hoisting mechanisms which include a crown block at the top of the mast and a traveling block suspended from the crown block by wire rope commonly referred to as wireline. It is common for the traveling block to be separated from the mast for transport to the next well. For this purpose the re-usable wireline is removed from the hoisting system and is stored on a spool for transport. The wireline spool may be mechanically driven so that it rotates about an axis. The rotation about the axis will wind or unwind the wireline on the spool. The rotation may be accomplished by an electric gear motor or other mechanical device. The motor may include various gearing and clutch mechanisms.

Various devices and systems have been proposed in the past to wind cables, such as wirelines and electric lines, onto a reel, drum or spool having a central cylinder with an axis and a pair of side flanges. In addition to winding mechanisms, various devices have been proposed to guide the cable onto the reel. In various prior art systems, winding drive mechanisms rotate both the reel and the guide device.

It has been suggested that unevenly spooled cable becomes worn more readily than evenly spooled cable. A guide can reduce gaps left between adjacent wraps and reduce accumulation of wraps at the side flanges of the reel or drum.

Other proposals in the past include Wilkinson (U.S. Pat. No. 2,990,136) which discloses a spooling guide device for winding cable in a drum. The carriage 16 is arranged to slide freely along horizontal guide tabs 10 controlled by fluid pressure. Additional movement of the spooling device may be accomplished by swinging the arms 12 about an axis of pivot bolts 14.

Wilson (U.S. Pat. No. 2,660,382) discloses a cable winding device utilizing a guide head 20 traveling on rods back and forth from end to end on the drum and arms 11 to allow backward and forward movement of a carriage C which moves the rods.

Thorson et al. (U.S. Pat. No. 2,946,561) discloses a rotatable drum of draw works 24 having a sheave 38 swivelly mounted on the draw works 24. The sheave moves on carriage 42 which moves on guides 41.

There remains a need for a guide for a wireline spooler which includes a mechanism which may be variably controlled and independently operated to reciprocate the spooler guide horizontally parallel to the spooler.

Additionally, there remains a need to provide a guide for a wireline spooler having an independent mechanism which is variably controllable to raise or lower the spooler guide in a direction vertical to the horizontal movement in order to engage or disengage the spooler guide from the wireline.

SUMMARY OF THE INVENTION

The present invention provides a spooler guide device which may be used in various types of drilling rigs and may also be used in various applications where wireline is taken on and off of a reel, drum or spool. A mechanically driven wireline spooler has a central cylinder with an axis and a pair of opposed flanges perpendicular to the axis. The spooler will be driven to wind cable in one direction and will unwind cable in the opposite rotation direction. The speed of the motor may be increased or decreased by a controller.

The spooler guide of the present invention would be spaced from the spooler, intermediate between the spooler and the mast or other rig in which the wireline operates. The spooler guide device includes a mechanism to reciprocate a carriage which travels in a path parallel to the spooler and its axis. The carriage includes a cylinder with a rod passing therethrough. The carriage also includes a centrally located piston which remains in place while the carriage moves laterally from side to side in a reciprocating motion. The cylinder is moved by hydraulic force or other action.

Extending from the carriage is a fairlead comprised of a pair of upstanding fingers which receive the wireline therebetween. The travel of the carriage laterally will be both monitored and controlled by a control.

A stabilization mechanism is also provided. The carriage has a downwardly extending slotted bar which surrounds and travels over a tongue extending from a beam on a skid.

The guide device also includes a mechanism to move the carriage vertically in relation to the reciprocal lateral movement of the carriage. A pair of cylinders raise and lower the carriage with relation to the beam. Each cylinder will include a centrally located piston with a rod passing therethrough. Each piston is centrally located and remains in place during any vertical movement.

The vertical adjustment mechanism may be operated by a control at the control box. The vertical adjustment mechanism operates independent of the horizontal, lateral movement mechanism is also independent of any drive mechanism for winding of the spooler.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
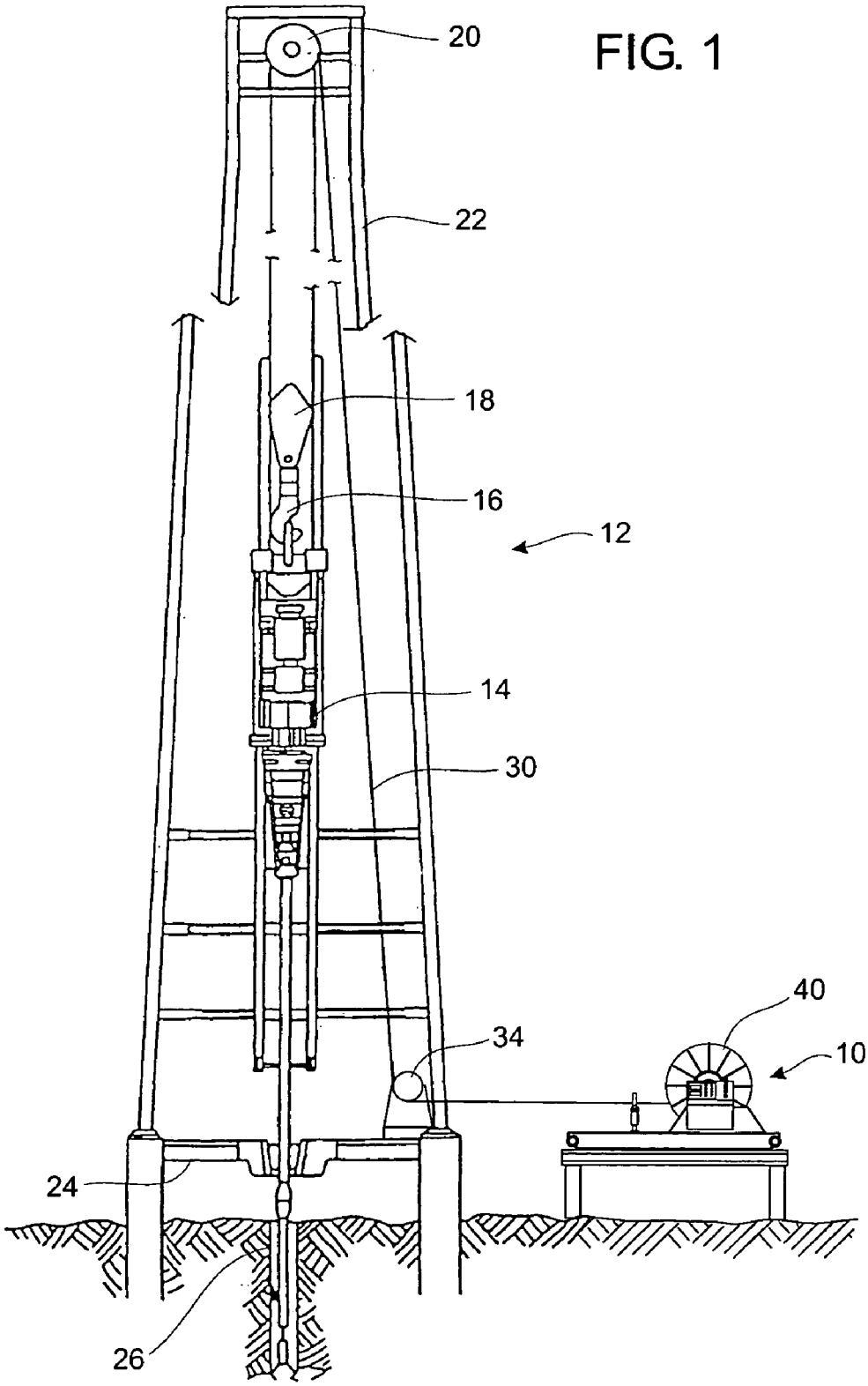
FIG. 1 shows a perspective view of a spooler guide device constructed in accordance with the present invention adjacent to and in operation with a drilling rig.

Referring to the drawings in detail, FIG. 1 shows a spooler guide device 10 constructed in accordance with the present invention adjacent to and in operation with a drilling rig 12. The present invention may be used with various types of drilling rigs utilizing wireline including a power swivel type drilling unit as shown in FIG. 1. Moreover, the present invention may be used in various applications where wireline is taken on or off of a reel, drum or spool.

A power swivel 14 is suspended and supported by a hook 16 connected to a traveling block 18, all of which is suspended from a crown block 20 mounted at the top of a mast or derrick 22.

The mast or derrick 22 includes a floor 24 with the mast or derrick 22 mounted over a well bore 26. Wireline 30 suspends the power swivel 14, hook 16 and traveling block 18. The wireline is reeved over the crown block 20 and the traveling block 18. A dead line anchor 34 is fixed on the floor 24 of the mast or derrick. Wireline 30 travels therefrom to a wireline spool, drum or reel 40.

The foregoing description is one of a number of arrangements known to those skilled in the art, may be varied in various ways, and further description is not required.

Figure 2:
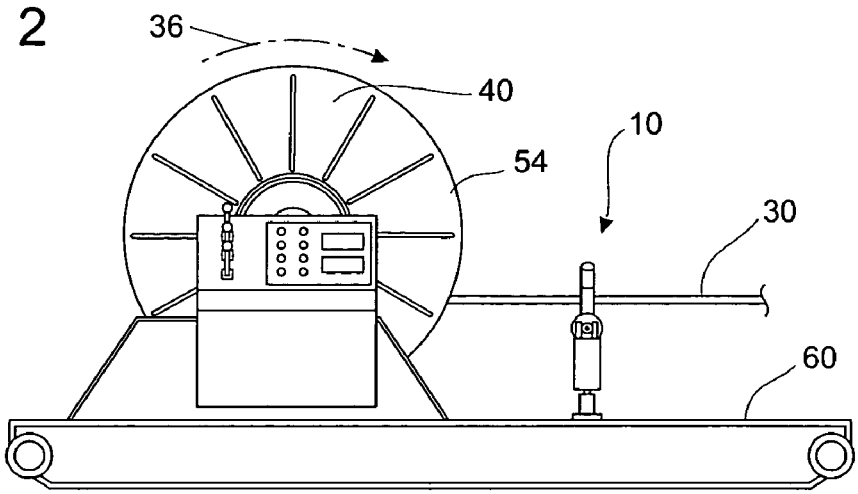
FIG. 2 illustrates a side view of the spooler guide device of the present invention shown in FIG. 1 in operation with a wireline spooler.
Figure 3:
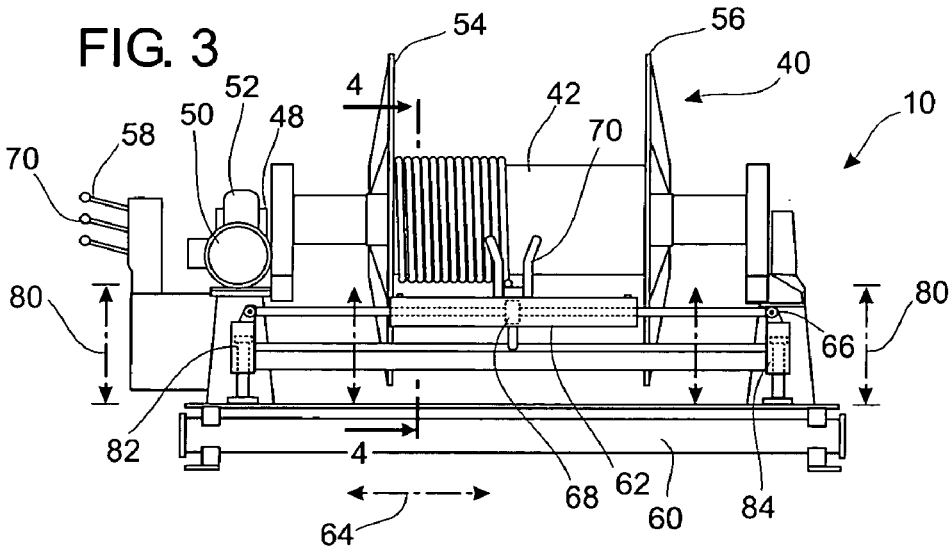
FIG. 3 illustrates a front view of the spooler guide shown in FIG. 2.

FIG. 2 illustrates a side view of the wireline spooler 40 along with the spooler guide 10 of the present invention, while FIG. 3 illustrates a front view of the spooler guide 10.

The wireline spooler 40 has a central cylinder 42 with an axis and a pair of flanges perpendicular to the axis. The wireline spooler 40 is mechanically driven and might typically include a gear motor 50 with a gear reducer 52 and a right angle drive coupled to a drum shaft 48 coaxial with the axis of the spooler. The gear motor 50 may be coupled to the shaft by a chain or other known mechanism. The spooler includes a pair of opposed flanges 54 and 56. The speed of the motor 50 may be increased or decreased by a control 58 located at a control panel 32. The spooler will wind cable 30 in the direction shown by arrow 36 in FIG. 2 and will unwind cable in the opposite direction.

The spooler guide 10 would be mounted on a base or skid 60 which may also be used to support the spooler 40 and its controls. The spooler guide 10 would be spaced from the spooler 40, intermediate between the spooler 40 and the mast or other rig on which the wireline 30 operates.

The guide 10 includes a mechanism to reciprocate a carriage 62 which travels in a path parallel to the spooler 40 and its axis. The carriage 62 travels in a direction shown over a distance illustrated by arrow 64. The carriage 62 includes a cylinder with a rod 66 passing through the length of the guide. The carriage 62 also includes a centrally located piston 68 (shown in dashed lines). The piston 68 stays centrally located at all times and the cylinder in the carriage moves laterally from side to side in a reciprocating motion. The cylinder is moved by hydraulic action in the preferred embodiment but mechanical action may be used.

Extending from the carriage 62 is a fairlead 70 comprised of a pair of upstanding fingers which will receive the wireline 30 therebetween. As the carriage 62 moves back and forth laterally, the wireline within the fairlead will also reciprocate.

The carriage will be driven by an hydraulic, pneumatic or mechanical system as is well known in the art. The travel of the carriage will be both monitored and controlled by control 70.

Figure 4:
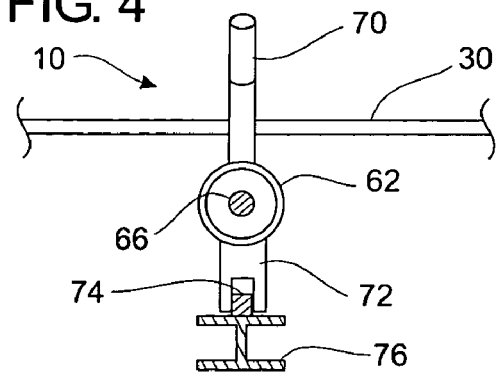
FIG. 4 illustrates a sectional view of the spooler guide taken along section line 4—4 of FIG. 3.

FIG. 4 shows a sectional view of the guide device taken through section line 4—4 of FIG. 3. The carriage 62 travels on a rod 66. A stabilization mechanism is also provided. The carriage has a downwardly extending slotted bar 72 which surrounds and travels over a stationary tongue 74 extending from a beam 76 on the skid which acts to stabilize the movement of the carriage.

The guide 10 also includes a mechanism to move the carriage, the extending fairlead and the wireline 30 vertically in relation to the reciprocal movement of the carriage. The direction and length of movement vertically is illustrated by arrows 80. A pair of cylinders 82 and 84 raise and lower the rod with relation to the beam 76. The vertical adjustment mechanism serves a number of purposes. Each cylinder 82 and 84 will include a centrally located piston with a rod passing therethrough.

The vertical adjustment will keep the wireline 30 at a position tangent to the cylinder of the spooler 40 as the wireline 30 winds or unwinds therefrom. Additionally, the vertical mechanism can lower the fairlead so that it does not operate at all in conjunction with the spooler and the wireline does not pass therethrough.

The vertical adjustment mechanism may be operated by a control 86 at the control box. The vertical adjustment mechanism is independent of the horizontal lateral movement mechanism and is also independent of the winding of the spool.

Whereas, the present invention has been described in relation to the drawings attached hereto, it should be understood that other and further modifications, apart from those shown or suggested herein, may be made within the spirit and scope of this invention.

What is claimed is:

1. A guide device for a wireline spooler having an axis, which guide comprises:

a carriage spaced from said wireline spooler comprising a cylinder, a fairlead to receive a wireline comprising a pair of upstanding fingers and a downwardly extending slotted bar;

means to reciprocate said carriage horizontally parallel to said spooler axis comprising a rod having a centrally located piston and that extends through the carriage;

a stationary tongue that the downwardly extending slotted bar surrounds and travels over; and means to raise and lower said carriage in a direction vertical to said means to reciprocate said carriage horizontally.

2. A guide device for a wireline spooler as set forth in claim 1 wherein said means to reciprocate said carriage horizontally parallel to said spooler axis operates independently of said means to raise and lower said carriage.

3. A guide device for a wireline spooler as set forth in claim 1 wherein said means to reciprocate said carriage horizontally includes at least one mechanical actuator.

4. A guide device for a wireline spooler as set forth in claim 1 wherein said means to raise and lower said carriage includes a pair of aligned hydraulic cylinders.

5. A guide device for a wireline spooler as set forth in claim 1 wherein said means to raise and lower said carriage includes at least one hydraulic cylinder.

6. A guide device for a wireline spooler as set forth in claim 1 wherein said means to raise and lower said carriage includes a mechanical actuator.

7. A guide device for a wireline spooler as set forth in claim 1 wherein said wireline spooler is mechanically driven and wherein said means to reciprocate horizontally and said means to raise and lower said carriage operate independently of said spooler.

* * * * *